US005657733A

United States Patent [19]

Dozier et al.

[11] Patent Number: 5,657,733

[45] Date of Patent: Aug. 19, 1997

[54] FUEL INJECTOR MOUNTING FOR MOLDED INTAKE MANIFOLD WITH INTEGRATED FUEL RAIL

[75] Inventors: Henry C. Dozier, Troy; Russell J. Wakeman, Canton, both of Mich.

[73] Assignee: Siemens Electroic Limited, Windsor, Canada

[21] Appl. No.: 589,236

[22] Filed: Jan. 22, 1996

[51] Int. Cl.[6] ..... F02M 55/02

[52] U.S. Cl. ..... 123/470; 123/531; 123/456

[58] Field of Search ..... 123/470, 472, 123/531, 533, 52 M, 468, 469, 456

[56] References Cited

U.S. PATENT DOCUMENTS

| | | | |
|---|---|---|---|
| 4,369,747 | 1/1983 | Jahoda | 123/531 |
| 4,909,221 | 3/1990 | Heuser | 123/470 |
| 5,054,456 | 10/1991 | Rush | 123/470 |
| 5,156,124 | 10/1992 | Sugimoto | 123/470 |
| 5,357,931 | 10/1994 | Semence | 123/470 |
| 5,465,699 | 11/1995 | Voigt | 123/470 |

FOREIGN PATENT DOCUMENTS

| | | | |
|---|---|---|---|
| 2208887 | 9/1973 | Germany | 123/470 |
| 0200062 | 11/1984 | Japan | 123/470 |
| 0215960 | 12/1984 | Japan | 123/470 |

*Primary Examiner*—Carl S. Miller
*Attorney, Agent, or Firm*—Russel C. Wells

[57] ABSTRACT

A mounting arrangement and method for installing fuel injectors in a molded composite intake manifold having an integral fuel rail portion in which the injectors are first assembled into bores in the fuel rail portion, and the intake manifold advanced onto a cylinder head surface having bores extending perpendicularly into the surface so as to allow the tips of the fuel injectors to be seated therein at the same time as the manifold is mounted. Air assist passages are also integrally formed in the intake manifold aligned with passages in the cylinder head.

9 Claims, 2 Drawing Sheets

FUEL INJECTOR MOUNTING FOR MOLDED INTAKE MANIFOLD WITH INTEGRATED FUEL RAIL

BACKGROUND OF THE INVENTION

Modern automotive engine designs use fuel injectors for controllably injecting a controlled quantity of fuel for each engine cycle into a passage in the cylinder head or manifold runner in the region of each intake valve or valves.

The fuel is supplied via a fuel rail, which in the past comprised a separate tube assembled to the manifold, each injector assembled into a pocket bore in fuel rails and also into an aligned seat in the manifold or cylinder head. Molded intake manifolds constructed of a composite plastic have now been developed, which would allow the fuel rail or rails to be integrated into the manifold as an integrally molded internal passage. This further development would significantly reduce costs by eliminating the fuel rail as a separate part as well as the additional parts and equipment required for installation of the separate fuel rail.

However, assembly of the fuel injectors into an integrated fuel rail and later into separate injector seats would have heretofore been impossible as the integrated fuel rail cannot be shifted axially to allow insertion of the fuel injector tips into the injector seats.

U.S. Pat. No. 5,465,699 issued on Nov. 14, 1995 for an "Intake Pipe Arrangement for an Internal Combustion Engine Having Individual Arc Shaped Cylinder Intake Pipe" describes a solution to this problem which necessitates a separate intermediate flange, increasing the costs.

The problem is made more difficult when an air assist connection must be made to each injector for supplying air used to assist in fuel atomization.

The object of the present invention is to provide a mounting for fuel injectors to be installed in an integrated manifold fuel rail, which may also have integrated air supply passages which allows completion of the injector installation without the need for a separate fuel rail or auxiliary flange.

SUMMARY OF THE INVENTION

The above object is achieved by an arrangement in which a series of injector seat bores are machined into the cylinder head, with an axis thereof extending normally to an angled cylinder head surface against which the intake manifold flange is abutted when installed at the same time extending parallel to manifold mounting studs.

An integrated fuel rail is formed with a series of bores forming pockets for receiving an upper end of an injector body, the pocket bores aligned with the cylinder head seat bores when the manifold is installed.

The injectors are first assembled to the manifold, their upper ends received in the pocket bores and secured so as to not fall out. At assembly, the tip ends of the injectors are each placed in a cylinder head bore. The manifold is then advanced onto the manifold, guided on the mounting studs.

The axis of the injectors is thus normal to the manifold flange mounting surface so that the injectors can be seated at the same time that the manifold is advanced onto the cylinder head, capturing the fuel injectors between a fuel rail portion of the manifold and the cylinder head.

The fuel injector is sealed with conventional O-ring sealing while the manifold can be sealed with conventional molded elastomer seals.

The manifold can also be formed with air assist flow passages, communicating with an air assist air rail in the cylinder head connecting to each injector seat.

Alternatively, the manifold mounting flange can be provided with an open slot covering a cross drill to each injector seat, or the air passage could be molded into the manifold.

DETAILED DESCRIPTION

Figure 1:
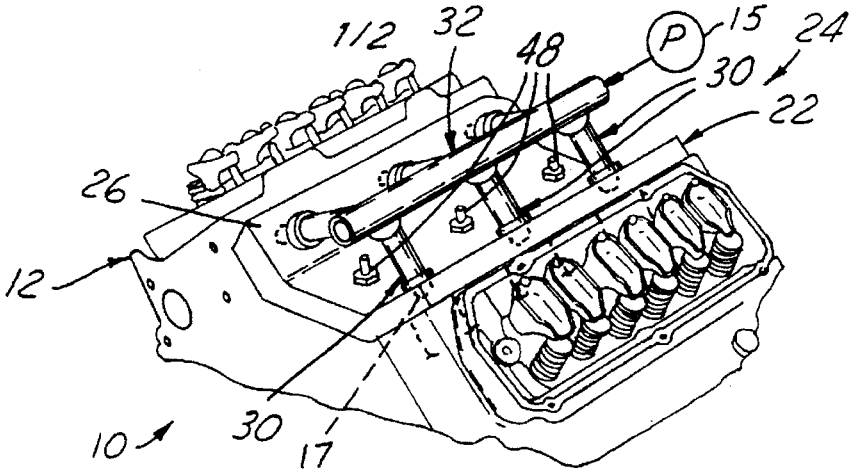
FIG. 1 is a fragmentary perspective view of an engine with an integrated fuel rail intake manifold and a fuel injector mounting according to the invention.
Figure 2:
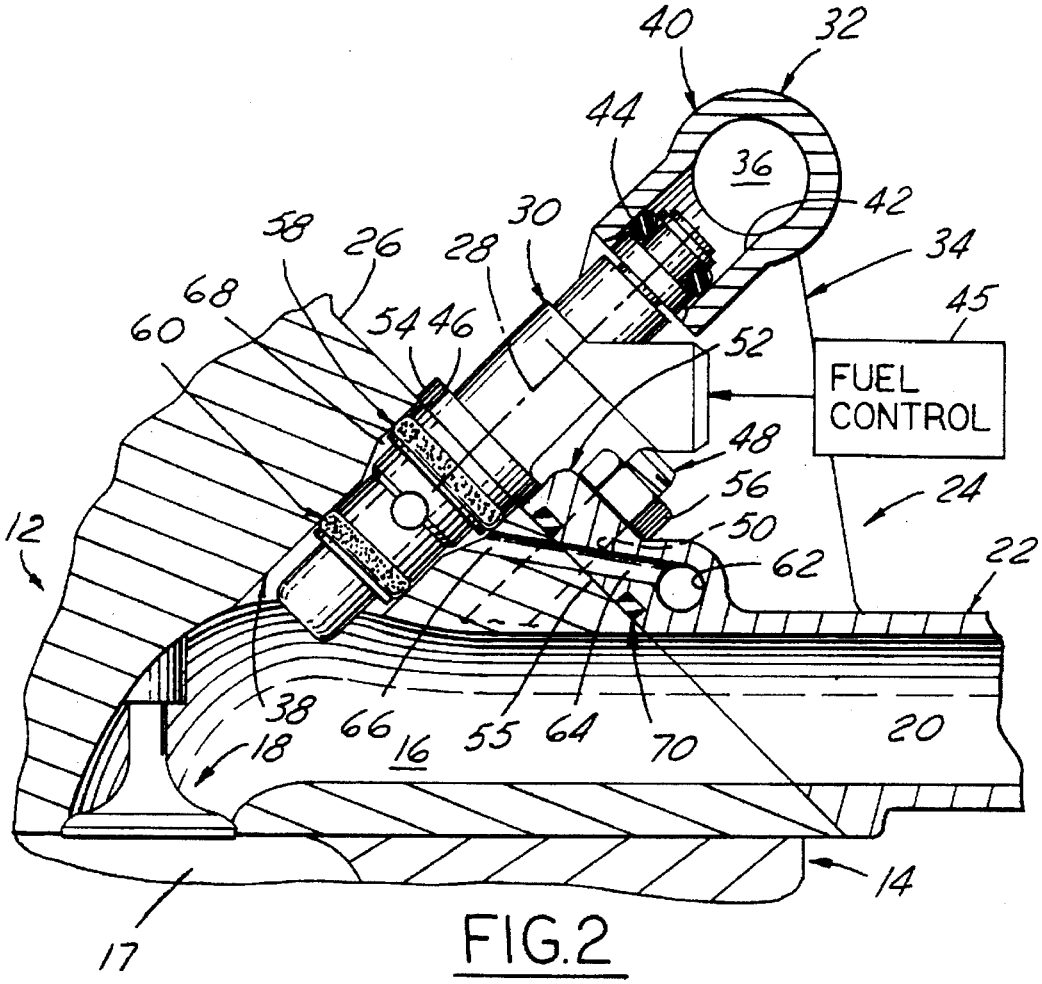
FIG. 2 is a fragmentary, partially sectional view of an internal combustion engine showing a fuel injector mounting adapted to an integrated fuel and air rail intake manifold, according to a first embodiment of the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a fragmentary view of an internal combustion engine 10 is shown with a cylinder head 12 mounted to an engine block 14 in conventional fashion.

The cylinder head 12 has a runner passage 16 for each engine cylinder extending to an intake valve or valves 18 at each cylinder intake port. Each cylinder head runner is aligned with a runner passage 20 of a runner 22 of an intake manifold 24.

The cylinder head 12 is formed with an angled manifold mounting surface 26.

The angling of the cylinder head surface 26 orients it to be perpendicular to axis 28 of the fuel injectors 30, which are oriented to direct a spray of fuel at the cylinder intake port when the valve 18 is opened in the manner well known in the art.

The intake manifold 24 may be injection molded of a plastic composite material or of conventional cast aluminum construction, including an integral fuel rail portion 32, supported as by pylons 34 defining an internal fuel supply passage 36 adapted to be supplied with fuel under pressure from the fuel pump 15 for supplying a plurality of fuel injectors operated by fuel controls to direct a controlled flow of fuel into a respective engine cylinder 17 at timed intervals, in the manner well known in the art.

The fuel rail portion 32 extends above the cylinder head surface 26 into which a series of fuel injector tip seat bores 38 are machined or molded, each extending normally to the cylinder head surface 26 and into a respective cylinder head runner passage 16.

The fuel rail portion 32 itself is formed with a series of protuberances 40 projecting normally to the cylinder head surface 26 and having pocket bores 42 formed therein which are aligned with a respective fuel injector tip in the seat bore 38 when the manifold 24 is installed, but axially spaced apart.

The fuel injectors 30 are first installed in the pocket bores 42, O-ring seals 44 employed in the conventional fashion.

The injectors 30 are clipped (not shown) or otherwise secured to be held in the bores 42. The wiring harness (not shown) from a fuel control 45 could also be installed at this time to minimize an engine assembly.

The fuel injectors 30 extend along their final installed axis at this time so that the injector tips may be inserted into the upper large diameter counter bore 46 of the tip seat bores 38 as the manifold 22 with the already installed fuel injectors 30 is advanced towards the surface along a perpendicular line of advance.

Mounting studs 48 project perpendicularly from the surface 26 and extend parallel to the direction that the manifold extends and may pilot in holes 50 in the manifold mounting flange 52 to maintain proper alignment during this procedure.

The injectors 30 are each located fully seated by the abutment of land 54 against the surface 26 as the manifold mounting flange is seated onto the cylinder head surface 26. Nuts 56 secure the manifold in the installed position.

Sealing O-rings 58, 60 seal the tips of the injector in the seat bores 36 in the usual fashion.

The manifold flange 52 mounts elastomer seals in grooves formed into its mating face 55, neither of which being shown since these are well known in the art and serve to seal the perimeter of the manifold face 55 to the cylinder head surface 26.

The intake manifold 24 can also advantageously be formed with an integrated air assist supply passage 62 supplied with air from the air cleaner (not shown) and connected to an air assist port passage 64 aligned with a similar port passage 66 in the cylinder head extending to an annular chamber 68. Chamber 68 is located to supply air to the injector 30 to assist in atomization in the manner well known in the art.

An additional elastomeric seal 70 can be used to seal the air supply port passages 64, 66.

Figure 3:
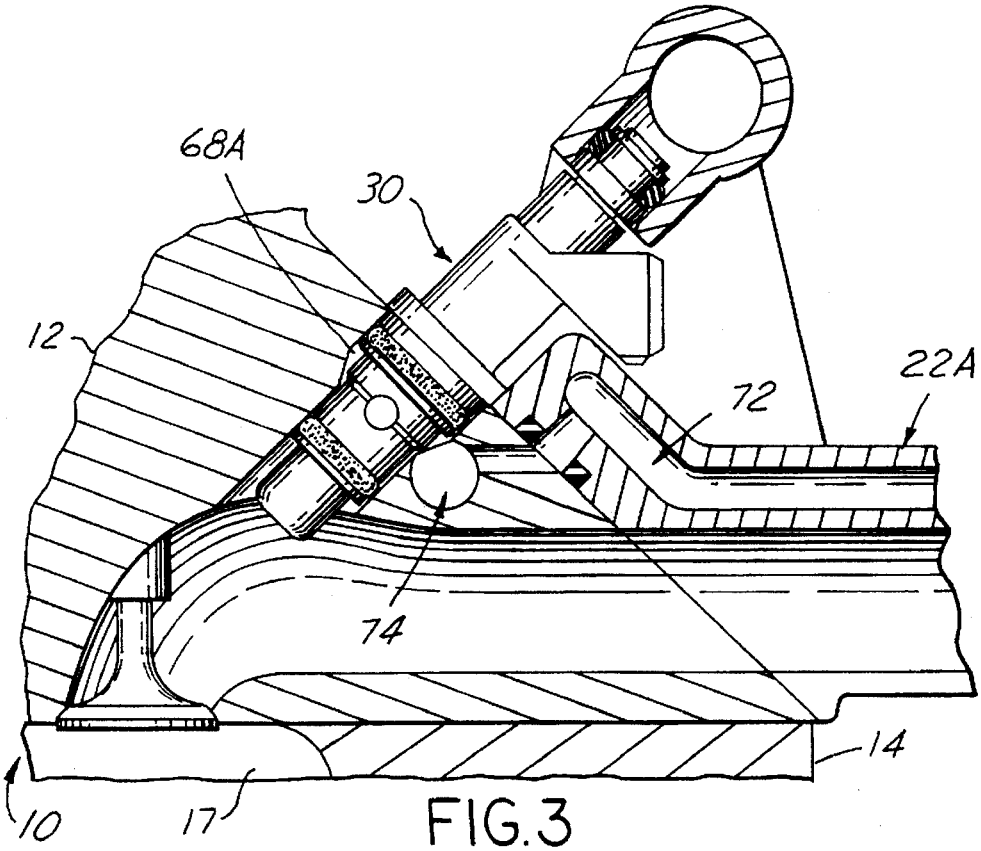
FIG. 3 is a fragmentary, partially sectional view of an internal combustion engine showing a fuel injector mounting adapted to an integrated fuel and air rail intake manifold, according to a first alternate embodiment of the present invention.

FIG. 3 shows an alternate arrangement of providing an air assist supply passage 72 which communicates and supplies a cored passage 74 in the cylinder head. The air assist supply passage 72 is shown molded in one of the runners 22A, communicating with a molded air cleaner box (not shown), eliminating external hoses completely. Alternatively, a series of molded supply passages 72, one in each runner 22A could be used to eliminate cored passage 74.

Figure 4:
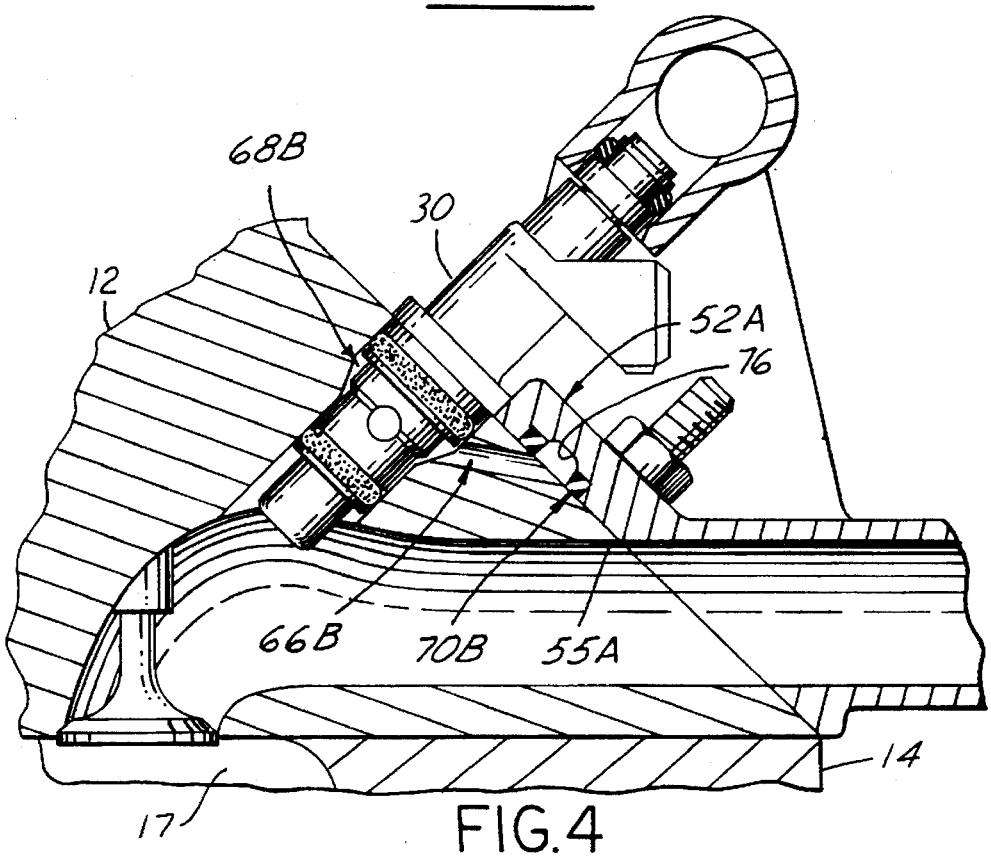
FIG. 4 is a fragmentary, partially sectional view of an internal combustion engine showing a fuel injector mounting adapted to an integrated fuel and air rail intake manifold, according to a second alternate embodiment of the present invention.

FIG. 4 shows another lower cost arrangement in which a groove 76 is formed into the mounting surface 55A of the manifold flange 52A, a seal 70B provided on either side of the groove 76. The groove 76 comprises an air assist supply passage which communicates with port passages 66B extending into a respective air assist chamber 68B surrounding each injector 30.

The use of groove 76 eliminates long core passages and can be formed by a detail in the manifold flange face 55A.

We claim:

1. An air assist fuel injector mounting arrangement for an internal combustion engine of the type having an engine block having a plurality of engine cylinders mounted therein, a cylinder head mounted to the cylinder block, an intake manifold mounted on the cylinder head and having a plurality of runners, each adapted to supply air flow to a respective engine cylinder, a plurality of fuel injectors each adapted to direct a spray of fuel into the air flow into each runner;

the intake manifold having an integral fuel rail portion for supplying pressurized fuel to the plurality of fuel injectors by means of pocket bores:

an air assist supply passage integrally formed in the intake manifold communicating with air passages in the cylinder head connecting with stepped fuel injector bores in the cylinder head;

wherein said fuel injectors are each mounted in axially aligned, spaced apart stepped bores formed in the cylinder head and said pocket bores formed in the fuel rail portion respectively; and wherein said intake manifold is formed with a mounting flange abutting said cylinder head surface, and wherein said air supply passage is formed by a surface groove let into said manifold face.

2. An air assist fuel injector mounting arrangement according to claim 1 wherein said cylinder head is formed with a mounting surface for said intake manifold, and wherein said axis of said spaced apart stepped bores extends perpendicularly to said cylinder head surface.

3. An air assist fuel injector mounting arrangement according to claim 2 wherein said intake manifold is received onto a series of studs projecting from said cylinder head manifold mounting surface, extending parallel to said axis of said fuel injector stepped bores and said pocket bores.

4. An air assist fuel injector mounting arrangement according to claim 2 wherein said cylinder head is formed with respective runner passages each aligned with a corresponding intake manifold runner, and wherein each of said fuel injector stepped bores in said cylinder head enter into a respective cylinder head runner passage.

5. An air assist fuel injector mounting arrangement according to claim 1 wherein said manifold air passage connects to a supply passage in said cylinder head connecting said each fuel injector stepped bore.

6. An air assist fuel injector mounting arrangement according to claim 1 wherein said fuel rail portion is supported on a series of integrally molded pylons.

7. A method of mounting a series of fuel injectors for an internal combustion engine having a cylinder head and an intake manifold mounted to a surface of said cylinder head, comprising the steps of:

molding said intake manifold with an integral fuel rail portion for receiving a flow of fuel under pressure for said fuel injectors;

molding a series of fuel injector bores into said intake manifold fuel rail portion, each configured to receive one end of a fuel injector;

forming a series of fuel injector bores in said cylinder head aligned with said bores in said intake manifold when assembled thereto, said cylinder head bores extending perpendicularly into said surface of said cylinder head;

assembling one end of each of said fuel injectors into a respective one of said intake manifold bores; and, advancing said manifold onto said cylinder head surface with opposite ends of said fuel injectors aligned with said cylinder head bores, whereby said fuel injectors are seated into said bores as said manifold is moved against said cylinder head surface.

8. The method of claim 7 further including the steps of guiding said intake manifold as said manifold is advanced into said cylinder head surface on a series of studs mounting projecting perpendicularly from said cylinder head surface.

9. The method of claim 7 additionally including connecting an air source through an air assist passage in the intake manifold to a port passage in the cylinder head to the stepped bores in the cylinder head.

* * * * *